United States Patent [19]

Fisher

[11] 4,152,747

[45] May 1, 1979

[54] IONIZATION PROMOTING ELECTRODE AND METHOD FOR INCREASING IONIZATION EFFICIENCY

[75] Inventor: Carl B. Fisher, Mendon, N.Y.

[73] Assignee: Xerox Corporation, Stamford, Conn.

[21] Appl. No.: 773,446

[22] Filed: Mar. 2, 1977

[51] Int. Cl.[2] ..... G03G 15/02; C23C 13/02

[52] U.S. Cl. ..... 361/229; 96/1.5 R; 250/325; 427/251; 427/295

[58] Field of Search ..... 361/226, 227, 229, 230; 250/324, 325, 326; 427/295, 294, 251; 118/621, 622, 625, 638; 96/1 A, 1 C, 1 E, 1.5

[56] References Cited

U.S. PATENT DOCUMENTS

| | | | |
|---|---|---|---|
| 3,239,717 | 3/1966 | Peterson | 361/227 |
| 3,646,351 | 2/1972 | Jarvis | 361/229 X |
| 4,013,463 | 3/1977 | Leder | 96/1.5 |
| 4,015,029 | 3/1977 | Elchisak | 427/295 X |
| 4,016,310 | 4/1977 | Ing | 427/295 X |
| 4,019,902 | 4/1977 | Leder et al. | 96/1.5 |
| 4,046,565 | 9/1977 | Miller | 96/1.5 R |

*Primary Examiner*—Patrick R. Salce

[57] ABSTRACT

An electrode which has at least one internal channel and an adjustable gate or slot to permit passage of gaseous material to be ionized from the internal channel and then in proximity to one or more outside faces of the electrode in a suitable area of electron emission, the electrode being placed in an electrical field in convenient proximity to an electrode or body of opposite charge.

7 Claims, 3 Drawing Figures

IONIZATION PROMOTING ELECTRODE AND METHOD FOR INCREASING IONIZATION EFFICIENCY

The invention relates to a method for more efficiently ionizing photoconductive and other suitable material in vacuuo and further concerns a new more efficient electrode for carrying out the method whereby preparation of suitable metal surfaces and application of photoconductive or other layers thereto by vacuum deposition techniques can be efficiently carried out in one step with excellent control and with a minimal expenditure of time and money.

Photoreceptors, particularly those in the area of xerographic copying, normally comprise a photoconductive insulating layer of an ionizable element or alloy such as selenium (amorphous or trigonal) and selenium alloys as a selenium-arsenic alloy with varying amounts of dopants. Such materials are customarily applied in charge blocking contact to a supporting metal- or metal-covered charge-conductive substrate or base. Suitable substrates for such purpose include, for instance, aluminum, steel, nickel, brass, NESA glass or even corresponding metal-coated polymeric materials.

Photoreceptors are generally given a uniform electrostatic charge and the sensitized surface then exposed to an image pattern defined by an electromagnetic radiation, such as light to selectively dissipate the applied charge to obtain a positive latent electrostatic image. Such image is then customarily developed by applying oppositely charged electroscopic marking particles onto the charge-bearing surface.

Generally speaking, photoconductive layers suitable for carrying out the above functions have a specific resistivity of about $10^{10}$ to $10^{13}$ ohm-cm, in the absence of illumination. In addition, their resistivity must drop at least several orders of magnitude where exposed to the activating radiation.

Photoconductive layers capable of xerographic sensitization and exposure with respect to the above criteria also normally exhibit some loss in applied charge, even in the absence of light exposure. This phenomenon known as "dark decay" will vary somewhat with photoreceptor sensitivity and general usage. The existence of the problem of "dark decay" is well known and is usually controlled to a satisfactory extent by incorporation of thin barrier layers such as a dielectric film between the base or substrate and the photoconductive insulating layer. U.S. Pat. No. 2,901,348 of Dessauer et al, for instance, utilizes a film of aluminum oxide of about 25 to 200 angstrom or an insulating resin layer, such as a polystyrene of about 0.1 to 2 microns thickness for such purpose. With some limitations, these barrier layers function to allow the photoconductive layer to support a charge of high field strength while minimizing "dark decay." When activated by illumination, however, the photoconductive layer and barrier layer must become sufficiently conductive to permit substantial dissipation of the applied charge in light-struck areas within a short period of time.

In addition to the above-indicated electrical characteristics, it is now also very important that modern photoreceptors must meet rather stringent requirements with regard to mechanical properties such as flexibility and durability. Such additonal criteria becomes particularly important in modern automatic copiers operating at high speeds where the photoreceptor is in the form of an endless flexible belt (ref. U.S. Pat. No. 2,691,450). While belt-type photoreceptors have many advantages, there are also serious technical problems inherent in their use. High speed machine cycling conditions, for instance, require particularly strong adhesion between the photoconductive layer and the underlying substrate. Unfortunately, however, some of the most sensitive and efficient photoconductive materials are relatively brittle and do not generally adhere well, as films, to flexing metal substrates.

Various techniques and devices have been utilized to solve this problem.

In allowed U.S. application Ser. No. 605,136 of Leder et al, now U.S. Pat. No. 4,019,902; and Serial No. 605,135 of Leder, now U.S. Pat. No. 4,099,969; filed respectively on August 15, 1975, for instance, a glow discharge phenomena is utilized alone or in conjunction with standard vacuum deposition techniques for obtaining durable, strongly adherent photoreceptor components.

Unfortunately, however, the preparation and coating of suitably prepared base by such technique requires a substantial expenditure of both time and money.

It is, therefore, an object of the present invention to find a method for some efficiently utilizing glow discharge technology for preparation of xerographic photoreceptors.

It is a further object to more efficiently prepare and coat metal substrates with high energy photoconductive materials.

A still further object of the present invention is to more efficiently convert an inert gas or ionizable photoconductive material into high energy ions in a glow discharge.

THE INVENTION

These and other objects are achieved in accordance with the present invention by introducing one or both of an unionized inert gas and vaporized photoconductive material through an orifice, gate or slot in an electrode body into at least one area of dense emitted electron concentration bounded by two intersecting electrode faces of the electrode body, introduction being effected on or rear the line or apex formed by the two intersecting electrode faces and in convenient proximity to a second electrode or target body having a charge opposite to that of resulting ionized photoconductive material.

For purposes of the present invention, the electrode faces can be essentially planar or curvilinear in nature, and the intersection of the electrode faces preferably angle of about 20° to about 160°.

In addition, the use of shielding is considered useful although not mandatory.

Insofar as the introduction of inert or other ionizable material is concerned, it is found advantageous, as noted above, to bleed such material into an area of high electron emission concentration bounded by the intersecting electrode faces, through a slot or line of small orifices, etc., essentially following the apex of the intersecting faces.

An especially suitable electrode for purposes of the present invention contains, in combination, a first and second component having, in assembled configuration, at least one pair of common mating surfaces and one or more internal flow channels defined, at least in part, by such common mating surfaces; and external part feedably connected to said flow channels; contacting means for imparting an electrical potential to the assembled electrode; and sealing and adjustment means applied to one or more of said components for selectively regulating mating pressure and leakage of the desired ionizable gas from the channels and between the common mating surfaces to an external slot or similar orifice.

By feeding the desired ionizable gaseous or gassified material under pressure through the port and internal flow channels, and by regulating the flow of such material out of the channels and between the common mating surfaces to achieve a bleeding away of the channeled material along a line formed by the first and second components external to the electrode in an area of dense emitted electron concentration, ionization is effected in convenient proximity to an externally placed target body having a charge opposite to that of the ionized material.

BRIEF DESCRIPTION OF THE DRAWINGS

The invention will now be described with reference to the drawings in which.

DETAILED DESCRIPTION

Figure 1:
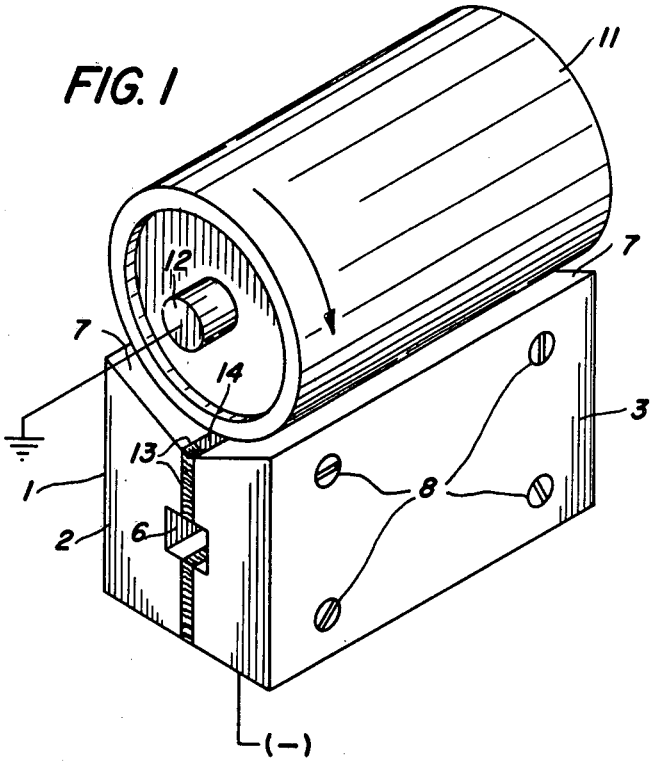
FIG. 1 shows a diagramatic isometric representation of a suitable electrode for obtaining and maintaining a glow discharge in carrying out the present invention.
Figure 3:
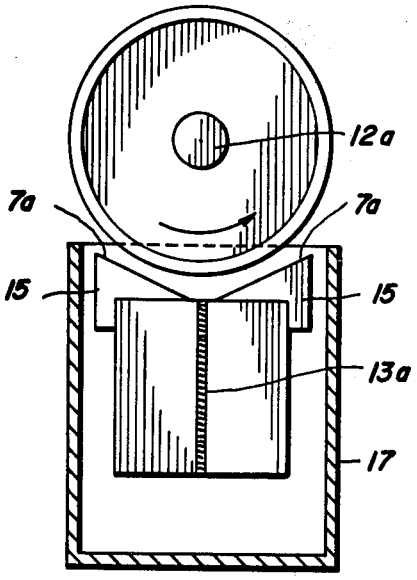
FIG. 3 is a diagramatic side view in partial section of another modification of the electrode of FIG. 1.
Figure 2:
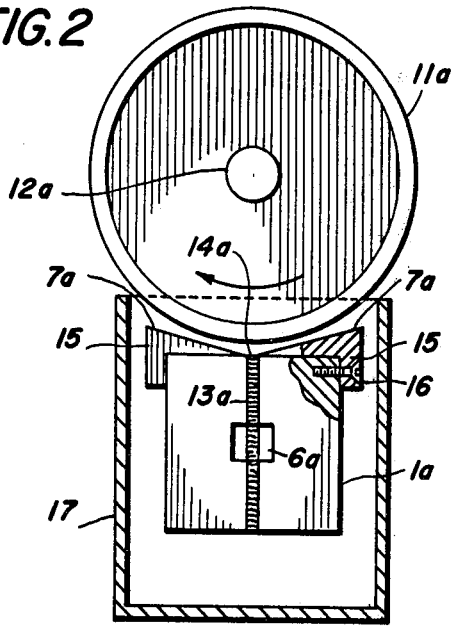
FIG. 2 is a diagramatic side view in partial section of a modification of the electrode arrangement of FIG. 1.

Further clarification can be found, for instance, in FIGS. 1–3, FIG. 1 being a diagrammatic isometric representation of a suitable two component electrode (1) and an anode target body (i.e. rotatably mounted metal substrate in the form of a drum) arranged in convenient proximity for obtaining and maintaining a glow discharge in carrying out the instant invention. FIGS. 2 and 3 are diagrammatic side views in partial section of a four-component modification of the electrode arrangement of FIG. 1 in which the electron emitting electrode faces (7*a*) are demonstrated as parts of replaceable units (15) secured by recessed screws (16) to permit a choice of intersecting angles for focusing the emitted electron concentration at a predetermined distance from the bleed slot (14*a*) for efficiently initiating and maintaining a glow discharge between electrode (1*a*) and the target drum (11*a*).

More specifically, FIG. 1 comprises, in combination, a first and second electrode component (2) and (3) having, in assembled configuration, at least one pair of common mating surfaces forming, at least in part, a desired focusing angle; in addition, such electrode conveniently includes an external port (not shown) feedably connected to flow channel (6), and also contacting means (not shown) for imparting the desired electrical potential to the assembled electrode and to the target anode (11), also one or more adjustment (8) and sealing (13) means applied to one or more of the two electrode components (2) and (3) for selectively regulating mating pressure between the components and leakage from channel (6) and between the common mating surfaces to feeder slot (14). In effect, utilization of this type electrode permits carefully controlled feeding of a desired ionizable gaseous or gassified materials under sight positive pressure within a vacuum coater, the bleeding of ionizable gaseous material being controlled by sealing means such as gasket material and adjustment means such as pressure screws to direct the flow to exit substantially along a line formed by the first and second electrode components in an area of known high density electron emission and in convenient proximity to an externally placed electrode of opposite charge.

Looking more specifically to FIG. 1 for further explanation of suitable embodiments of the present invention, we find a cathode (1) conventionally consisting of two metal components (2) and (3) such as machined aluminum or similar electron-emitting materials of poor sputtering characteristics. The channel resulting from mating the metal components is conveniently fed by an external port (not shown) which is conveniently feedably connected to a resistance-heated crucible containing selenium alloys or similar photoconductive material. Sealing means such as a foil gasket or soft flowable metal wire (13) (here shown in exaggeration relative thickness) and adjustment means (8) such as insulated pressure screws are conveniently placed to favor the direction and flow of the ionizable material flow internal channel (6) and between the common mating surface to bleeder slot (14) and then external to the electrode in an area of high density electron emission in convenient proximity to an externally placed anode such as a photoreceptor drum and mandrel (11) mounted on a rotatable spindle (12) and having a charge opposite to that of the desired metal ions.

FIGS. 2 and 3, as previously noted, are diagrammatic cross-sectional views, of a modification of FIG. 1, FIG. 3 being a front view in partial section having demountable wings (15) at a preferred angle to the horizontal and held in place by countersunk insulated screw (16) (shown in partial section). Shielding (17) is also an optical modification shown in cross section. The remaining parts of FIGS. 2 and 3 correspond essentially to their numerical counterparts in FIG. 1, the connotation "a" being utilized for convenience.

Suitable substrates of bases suitable for coating through the present invention can usefully consist of relatively thin metal foils of copper, steel, brass, aluminum, zinc, nickel, or even corresponding metal-coated flexible polymeric base such as a coated polyethylene terephthalate conveniently mounted on a mandrel within a vacuum coater and in convenient proximity to the electrode formed by elements (2) and (3) of FIG. 1. Of particular interest as substrates are aluminum-coated polyehtylene terephthalate belts and nickel belts.

Photoconductive material to be efficiently ionized by glow discharge in the instant invention are generally, although not exclusively, inorganic ionizable elements, such as selenium, selenium alloys inclusive of alloys of selenium with tellurium, germanium, antimony, bismuth and arsenic and/or one or more halogens such as chlorine, bromine, or iodine. Such materials are conveniently obtained, for instance, by subjecting selenium plus small amounts of arsenic, etc., and halogen to heat. The alloy is then conveniently vaporized in a closed crucible directed to channel (6) of the electrode described above through an access port (not shown).

While numerous modifications are possible, the initial step of obtaining a clean-oxidized substrate is most conveniently obtained by first bombarding the grounded substrate such as shown in FIG. 1 with electrons in the presence of limited amounts of air or a mixture of oxygen with at least one inert non-metallic ion-forming gas such as nitrogen, argon, xenon, etc., and thereafter exposing the resulting oxidized clean substrate to a high energy ion-containing photoconductor generated through slot 14 in a glow discharge as hereinafter described.

The initial bombardment of an anode such as elements (11) and (12) of FIG. 1 substrate with electrons to clean and oxidize is conveniently carried out, for instance, by evacuating a suitable modified vacuum coater down to a pressure of about $5\times10^{-5}$ Torr or better and then backfilling to about 5–30 micron pressure. A pressure of about 10–20 microns is generally preferred, however, for this purpose. While air under reduced pressure is acceptable, it is also found convenient to utilize various alternative mixtures of positive ion-producing and oxidizing gases at comparable pressures. Such include, for instance, argon-oxygen, argon-air, argon-$CO_2$, or a mixture of pure nitrogen and oxygen, etc., provided the amount of available oxygen for initial oxidation of the substrate is not less than about 1 percent by volume of the available gases. Such initial treatment can be carried out utilizing an electrode such as an aluminum cathode of FIG. 1, operating at a potential up to about 5000 v and preferably at about 3500–5000 volts, depending upon the type and pressure of gas used in the coater.

Prior to or immediately after completion of a period of time sufficient to lay down an oxide barrier layer of about 10–200 angstrom thickness and to heat the substrate or drum to a temperature of about 55°–80° C. (about 5–20 minutes and preferably 8–10 minutes under conditions indicated above), the grounded oxide-bearing substrate is exposed to a vapor cloud comprising both uncharged and high energy ionic photoconductive material evolved from a heated source, the vapor cloud having been exposed to a glow discharge to obtain the highest possible concentration of ions.

For purposes of the present invention, deposition of a photoconductive layer onto the clean pretreated substrate is best effected by separately heating the photoconductor donor source to a temperature between room temperature and the maximum evaporation temperature of the photoconductive material. For such purpose, the preferred temperature range (1) customarily favors maximum vapor concentration and field conditions commensurate with maintenance of a glow discharge pressure proximate to the heated photoconductor source and the substrate, and (2) favors the highest possible conversion of uncharged to charged (ions) photoconductor material to effect the impaction of the largest possible concentration of high energy photoconductor particles onto the substrate. The latter attribute is particularly appropos' to the electrode of the present invention.

As a practical matter, the initial pretreatment of a metal substrate, as above described, is best effected in an atmospheric pressure of about 5–30 microns, the amount of oxygen present being not less than about 1 percent by volume of available gases. In the subsequent photoconductor deposition step, however, it is both desirable and convenient to merely increase the amount of vacuum to about $5\times10^{-5}$ Torr or better and then backfill the coating chamber with up to about 1–30 microns of argon, nitrogen, xenon or similar relatively inert gases.

In order to effectively raise the vapor pressure of the photoconductive material for deposit onto the oxidized substrate, the photoconductor source is conveniently heated by a number of different ways. Such include, for instance, resistance heating of one or more crucibles or boats containing the photoconductor material, the use of an electron beam or gun directed at the unvaporized photoconductor material of the donor source, or even by ion beam heating of the photoconductor material. In any case, the optimum temperatures will vary with the photoconductive material, the distance between source and substrate and the atmospheric composition and pressure utilized.

By way of example, a crucible temperature up to about 350° C. and preferably about 180° C.–350° C. is found adequate for vaporizing selenium and most of the known selenium alloys under a pressure up to about 30 microns.

During the period of photoconductor deposition onto the clean oxide-coated substrate, it is essential in using an electrode of the present invention that a glow discharge be maintained for the purpose of creating high energy photoconductor ions without seriously limiting the rate and area of deposition of the photoconductive material onto the substrate. In any case, the second step is usefully carried out in the present invention so that the glow (ionization of the non-metallic gas atmosphere) automatically occurs in a location to intercept the largest possible amount of vaporized photoconductor material somewhere between the donor crucible and the substrate.

After a period sufficient to deposit about 0.5–10 percent of the desired photoconductor material (i.e. about 2–5 minutes), the glow discharge can be turned off, if desired, and coated pressure once more lowered to $5\times10^{-5}$ Torr or better, for conventional vapor deposition of the balance of the desired photoconductor material. Whether this procedure is followed or the entire amount is deposited under glow discharge, a substantial savings in time, expense and increased durability is indicated.

While the electrode of FIG. 1 is shown as a cathode, it is not necessary to limit the glow discharge to a D.C. glow, since both high energy positive and high energy negative selenium ions can be efficiently created by using the electrode and method of the present invention. Where an A.C. field is used, an additional advantage is also realized in that the accumulation of surface charges is discouraged during the glow discharge deposition.

EXAMPLE I

A nickel alloy test belt identified as A-1 and having a thickness of 4.5 mil (0.0045"), a length of 10" and a diameter of 4.75" is cleaned with a hot aqueous solution containing 10 percent by weight of "Mitchell Bradford #14 Cleaner" and then rinsed in deionized water for about 2 minutes.

Sample belt A-1 is mounted on a grounded rotatable mandrel in a vacuum coater about 6" away from a 16" long gounded stainless steel crucible equipped with resistive heating means and containing a photoconductor selenium alloy consisting essentially of about 99.5 percent selenium and 0.5 percent arsenic. Two 12"×1"×1" aluminum glow bars (5000 v) are mounted about 3" from the test belt, the first (GB1) being directed essentially at the belt in the 10 o'clock position and the second (GB2) is mounted at similar distance but at about 5 o'clock relative to the belt as center and directed substantially at the inerspace between the substrate belt and the stainless steel crucibles. After evacuating to $5\times10^{-5}$ Torr and backfilling the coater with 20 micron air pressure, negative 3000 volts is applied to the first glow bar (GB1) for about 10 minutes to heat and oxidize the belt. The first glow bar voltage is then turned off, coater pressure thereafter lowered to about 15 microns, the crucible heated up to 280° C., and the second glow bar (GB2) (3500 volts) turned on for about 20 minutes. The second glow bar is then turned off and straight vapor deposition permitted to proceed at reduced pressure ($5\times10^{-5}$ Torr) for about 15 minutes to obtain a total uniform photoconductor coating about 50 microns thick. During both steps, the mandrel is constantly rotated at about 10 revolutions per minute to obtain uniform exposure. The belt is then cooled, removed from the coater, tested for electrical properties and flex, and the results reported in Table I infra.

EXAMPLE II

A nickel alloy test belt identified as A-2 and having the same dimensions as belt A-1, is cleaned as in Example I and then mounted on a grounded rotatable mandrel in the same vacuum coater utilized in Example I with the exception that both glow bars are replaced with a single hollow cathode as described in FIG. 1, having gross external dimensions of about 16"×6"×6" and 30° open intersecting electrode-emitting faces, the open channel of this electrode being feedably connected to a shuttered floating resistance-heated crucible having the general dimensions of that described in FIG. 1 and filled with the same type selenium alloy used in Example. The hollow cathode is positioned at 5 o'clock relative to vertical with the belt as center and about 3" from the test belt as mounted. After evacuating the coater to $5\times10^{-5}$ Torr and backfilling the coater with 20 micron (mercury) air pressure, negative 3000 volts is applied to the hollow cathode for about 10 minutes to heat and oxide the belt. The coater pressure is then lowered to about 15 microns and the preheated (280° C.) crucible unshuttered to permit vaporized photoconductive material to flow through channel (6) and out bleeder slot (14) as described relative to FIG. 1, supra, for a period of about 10 minutes. Thereafter, the hollow electrode is turned off and vapor deposition permitted to proceed at $5\times10^{-5}$ Torr for about 25 minutes to obtain a total uniform coating about 50u in thickness. The belt is continually rotated as in Example I during the cleaning and coating steps described. The belt is then cooled to ambient conditions removing the coater, tested for electrical properties and flex and the results reported in Table I below.

TABLE I

| Test Belt | Capacitive Charge (v/u) | 20 Second Dark Decay v/sec | Mandrel Test* (1½" diameter |
|---|---|---|---|
| A-1 | 23 | 20 | P |
| A-2 | 21 | 16 | P |

*P = pass (no cracks or spalls observed)
F = fail (one or more cracks or spalls observed when belt bent once around a 1½" pipe at room temperature.

What is claimed is:

1. A metal electrode comprising, in combination a first and second component having, in assembled configuration, at least one pair of common mating surfaces, two intersecting electrode faces, and one or more internal flow channels defined, at least in part, by the common mating surfaces, an external port feedably connected to said flow channels; contacting means for imparting an electrical potential to the assembled electrode, sealing and adjustment means applied to at least one of said components for selectively regulating mating pressure and leakage from the channels and between said common mating surface, and means to provide a vacuum to said channels and between said common mating surface.

2. The metal electrode of claim 1 wherein the assembled first and second components have two intersecting electrode faces arranged at an angle of from about 20° to about 160° to each other.

3. The metal electrode of claim 1 wherein the intersecting electrode faces are essentially planar in nature.

4. The metal electrode of claim 1 wherein the intersecting electrode faces are essentially curvilinear in nature.

5. The metal electrode of claim 1 wherein the two intersecting electrode faces are parts of at least one demountable wing of predetermined angle secured to the balance of the electrode by holding means.

6. A method for efficiently converting an inert gas or ionizable material into high energy ions in a glow discharge comprising flowing one or both of an unionized inert gas and vaporized photoconductive material through one or more internal flow channels defined, at least in part, by at least one pair of common mating surfaces of an electrode having an electrical potential applied thereto and thereafter introducing said inert gas or photoconductive material through an orifice, gate or slot in said electrode into at least one area of dense emitted electron concentration bounded by two intersecting electrode faces of said electrode, introduction being effected in a vacuum on or near the line or apex formed by the two intersecting electrode faces and in convenient proximity to a second electrode or target body having a charge opposite that of resulting ionized photoconductive material.

7. A method of claim 6 wherein the inert gas or vaporized photoconductive material is bled from a slot forming a line along the apex of the intersecting electrode faces.

* * * * *